United States Patent [19]

Johnson

[11] 4,455,684

[45] Jun. 26, 1984

[54] SHOULDER PROTECTION DEVICE

[76] Inventor: Sam E. Johnson, 1519 Westbury Dr., Davison, Mich. 48423

[21] Appl. No.: 415,607

[22] Filed: Sep. 7, 1982

[51] Int. Cl.[3] ..... A41D 13/00

[52] U.S. Cl. ..... 2/2; 5/420

[58] Field of Search ..... 2/2, 22, 23, 24, 45, 2/DIG. 6; 5/420, 431, 432, 443

[56] References Cited

U.S. PATENT DOCUMENTS

| | | | |
|---|---|---|---|
| 2,637,032 | 5/1953 | Pinsuti | 2/23 |
| 3,323,151 | 6/1967 | Lerman | 5/420 |
| 4,353,133 | 10/1982 | Williams | 2/2 |

OTHER PUBLICATIONS

Church et al., *A Concise Guide to Plastics,* pp. 60 and 63, Second Edition, Copyright 1963, by Reinhold Publishing Corporation.

*Primary Examiner*—Werner H. Schroeder
*Assistant Examiner*—Judith L. Kravitz
*Attorney, Agent, or Firm*—Harness, Dickey & Pierce

[57] ABSTRACT

A thin flexible lightweight shoulder protection device for attachment to a shooter's garments to absorb rifle or similar firearm recoil loads. The device includes a flexible cover portion within which an energy absorbing pad is retained. The pad includes a flexible sealed envelope which houses an internal solid thermoplastic elastomer matrix which provides the device with its damping or energy absorbing capability. Retention means are provided for removably locating and securing the device at desired garment locations.

8 Claims, 4 Drawing Figures

SHOULDER PROTECTION DEVICE

BACKGROUND AND SUMMARY OF THE INVENTION

The present invention relates to shoulder protection devices, and more particularly, to a shoulder protection device particularly suited to absorb impact loads or forces directed to the shoulder area of a user during the discharge from shoulder-supported firearms such as rifles and the like.

As is well known, impact loads or forces caused by the rapid release of kinetic recoil energy of a shoulder-supported firearm as it decelerates against the shoulder can be a nuisance to the user of such firearms. Indeed, the faster the deceleration, the greater the shock or inpact load to the shoulder. Continuous and repeated use of heavy shoulder-supported firearms such as shotguns and rifles can thus be distressful, fatiguing and often painful for a marksman or hunter due to repeated and unavoidable recoil impact loads directed to the shoulder area. For this reason, to enable the user to shoot with more comfort and with less fatigue, it is often desirable to provide the user's shoulder with some sort of protective padding or covering to reduce the rate of firearm deceleration and at least partially absorb such loads.

There exist many types of energy absorbing devices or recoil pads intended to reduce the level of impact loads directed to a user's shoulder due to firearm recoil. Various padded outer garments, hunting vests and shoulder pad arrangements have been devised having energy absorbing materials which offer the user some means of protection against such recoil loads. However, since the energy absorbing material has a substantial influence on the rate of deceleration of the firearm, and thus the magnitude of impact load on the shoulder, the effectiveness of such devices depends upon the type of absorbing material utilized. Materials which have heretofore been used in such applications include felt, hair, layers of cloth, leather, hard rubber, sponge rubber, and foamed plastic. However, firm materials such as leather or hard rubber do not deform very quickly when subjected to a rapidly moving firearm. Such materials thus act more like a hard surface —they stop the firearm very quickly, and result in a sharp deceleration of the firearm, as well as substantial shock loading of the shoulder. Other materials such as sponge rubber, felt, hair and layers of cloth have interconnected air spaces which permit air displacement and a flattening or bottoming out of the material, whereupon they also behave more like a hard surface. While plastic foam offers an improvement over the previous materials, foam plastic material will exhibit the same bottoming out behavior in certain applications. Such behavior can be reduced by increasing the thickness of protective pads incorporating such materials. However, larger pad thickness is undesirable since it contributes to increased bulk and general profile of a shoulder protection device.

It is, therefore, desirable to provide a shoulder protection device for absorbing firearm recoil loads which allows the firearm to decelerate over a longer time period than that possible with prior devices, with an attendant smaller shock or impact load imparted to the shoulder of the user. It is moreover desirable to provide such a device having an energy absorbing material which allows for a relatively thin low profile protective pad which does not bottom out and act like a hard surface during firearm use.

The present invention is intended to satisfy the above desirable features through the provision of a new and improved shoulder protection device in the form of a thin flexible protective pad having a cover portion, an internal envelope and a solid internal energy absorbing thermoplastic elastomer matrix within the internal envelope. The firmness and composition of the matrix is such that it deforms quickly, allows for enhanced deceleration periods, and yet generates a restoring force so that it does not bottom out and act like a hard surface during use. The device includes retention means located on the external cover which allows the device to be removably retained at desired locations on a user's garment.

The above and other features of the invention will become apparent from a reading of the detailed description of the preferred embodiment, which makes reference to the following set of drawings.

DETAILED DESCRIPTION OF THE PREFERRED EMBODIMENT

Figure 1:
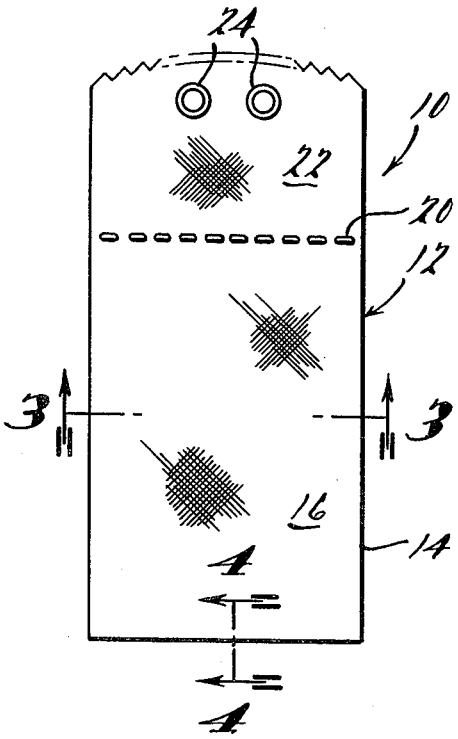
FIG. 1 is a frontal view of a shoulder protection device in accordance with the present invention.

Referring now more specifically to the drawings, a shoulder protection device in accordance with the present invention is indicated generally by reference numeral 10. The device 10 includes a cover portion 12 which is formed to define an external envelope 14 having a frontal face 16, a back face 18, and a thickness T. In the preferred embodiment, the cover portion 12 is formed from a single elongated piece of stretch fabric cloth which is folded over upon itself and stitched together longitudinally along its edges 19, as well as laterally along location 20 to define the external envelope 14. Such an operation also results in the formation of a tongue portion 22. A pair of eyelets 24 are provided in tongue portion 22 through which the device may be removably attached to a garment as described more fully hereinafter.

Figure 3:
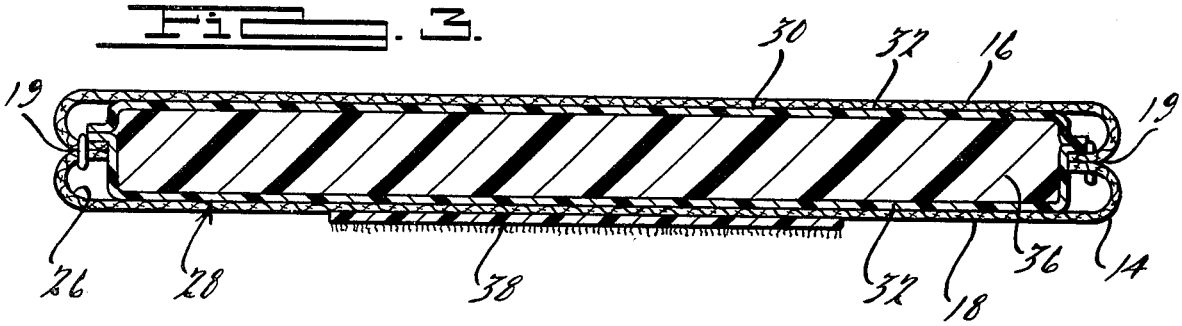
FIG. 3 is a sectional view taken in the direction of Line 3—3 of FIG. 1.
Figure 4:
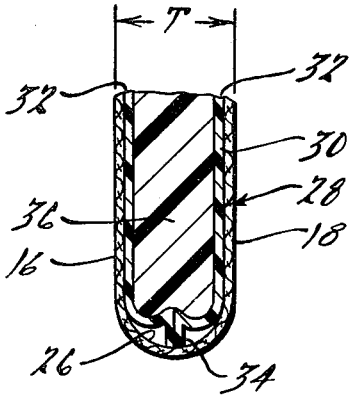
FIG. 4 is a partial sectional view taken in the direction of Line 4—4 of FIG. 1.

When formed in this manner, the external envelope 14 defines an enclosed recess 26 within which an energy absorbing pad 28 operative to absorb recoil forces is retained. The energy absorbing pad 28 includes an internal sealed envelope 30 formed by the mated assembly of a pair of complementary shaped flexible generally rectangular thin sheets of water resistant plastic film 32, which, in the preferred embodiment, are mated at their outer peripheral edges 34 by a heat sealing process. As shown in FIGS. 3 and 4, disposed within and contained by the internal envelope 30 is a solid thermoplastic elastomer matrix 36 which operates to provide the device 10 with its energy absorbing capability.

The matrix 36 is composed of a very soft solid polyurethene elastomer having many of the general properties normally associated with a rubber-like material: it stretches rapidly reaching a high elongation; it retracts rapidly; it returns to and retains its original fabricated shape after being deformed; it exhibits a tensile strength and stiffness when fully stretched and will thus fracture.

When subjected to the motion of a rapidly moving firearm, the solid elastomer deforms quickly, yet generates a restoring force of its own so that it does not bottom out and thus act like a hard surface. A form of the elastomer which is preferable for use for the internal matrix 36 is ACTION ELASTOMERIC manufactured by Action Products, Inc. of Hagerstown, Md. ACTION ELASTOMERIC is the trademark of a very soft polyurethene elastomer produced by Action Products, Inc. having elongation ranges of from approximately 300 to 1,200 percent, and having a specific gravity range of from approximately 1.02 to 1.03.

Figure 2:
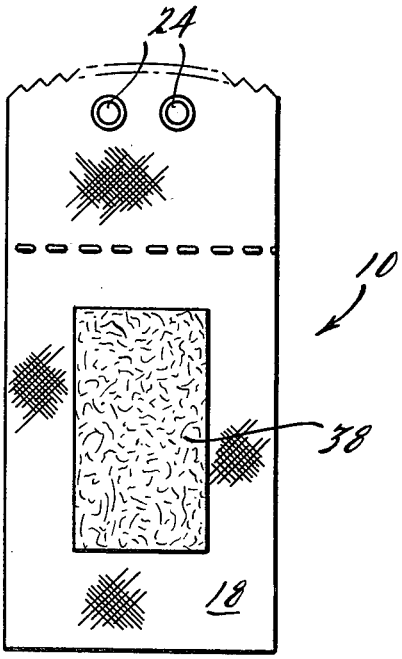
FIG. 2 is a rear view of the device shown in FIG. 1.

The device 10 may be removably secured at a desired location on a user's garments by way of a safety pin passed through the eyelets 24 in tongue 22. Alternatively, the device 10 may be secured at a variety of garment locations by using Velcro fasteners. To facilitate attachement in this manner, the device 10 can be provided with a Velcro pad 38 located along the back face 18 of external envelope 14 as shown in FIGS. 2 and 3. Once attached to the user's garment, the device 10 is utilized by seating the butt of a firearm against the front face 16 of external envelope 14 and discharging the firearm in a normal manner. Such discharge will cause the firearm to recoil and impart an impact load against the front face 16 of envelope 14. This load will in turn cause the pad 28 to compress in the direction of recoil against the user's body. Additionally, the high deformability of the matrix 36, as well as the flexible nature of internal envelope 30 and external envelope 14, allow the pad 28 to expand or bulge in a direction generally normal to the direction of recoil. The combination of these modes of deformation thus gives the pad 28 a high damping or energy absorbing characteristic well-suited for dissipating firearm recoil loads. It has been found that a device 10 suitable for trap or skeet shooting weapons can be provided with an overall thickness T of approximately $\frac{1}{4}$ inches. For heavier gauge weapons, such as a 300 Winchester Magnum or 458 Winchester Magnum, a device 10 with a thickness T of approximately $\frac{1}{2}$ inches is preferable.

It is understood that the foregoing description is that of the preferred embodiment of the invention and that various changes and modifications may be made thereto without departing from the spirit and scope of the invention, as defined in the appended claims.

What is claimed is:

1. A recoil and shock eliminating device for use in protecting the shoulder of a person operating a rifle or shotgun-type firearm, said device comprising a body disposed within an exterior flexible fabric cover which is constructed to envelope the body and provide attachment means to facilitate releasably securing the device to an associated garment, said body consisting solely of a molded polyurethane elastomeric thermoplastic material that is entirely solid so as to have no internal voids in the material, with said material being capable of distorting in response to a recoil force of an operating firearm juxtapositioned thereagainst, and having sufficient structural integrity to prevent the butt of the firearm from bottoming out against the user's shoulder and thereby absorb and eliminate the recoil force and shock of the operating firearm to prevent injury to the operator and reduce operator's fatigue resulting from both single firing and sustained operation of the firearm, said material having a specific gravity range of approximately 1.02 to approximately 1.03 and having an elongation range of from approximately 300 percent to approximately 1,200 percent.

2. A device as set forth in claim 1 wherein said body is disposed in a sealed flexible internal envelope.

3. A device as set forth in claim 2 wherein said internal envelope is defined by a pair of opposing flexible thin sheets matingly secured to one another adjacent their respective outer peripheral edges.

4. A device as set forth in claim 1 wherein said cover is formed from a single elongated piece of flexible fabric folded upon itself and matingly assembled along its longitudinal edges to define an external envelope having a front face and a back face and within which said body is disposed.

5. A device as set forth in claim 4 wherein said front face and said back face are secured to one another long a line extending between said longitudinal edges.

6. A device as set forth in claim 1 wherein said cover defines a closed external envelope within which said body is carried and which includes a tongue portion upon which said attaching means is located.

7. A device as set forth in claim 1 wherein said cover defines a front face and a back face, and which includes attaching means operative to interact with said back face and an associated garment to effect releasable attachment of said device to said garment.

8. The invention according to claim 3 wherein said internal envelope comprises a pair of thin flexible sheets of plastic film matingly assembled to each other adjacent their respective outer peripheral edges by a heat sealing process.

* * * * *